United States Patent [19]

Savoca et al.

[11] Patent Number: 4,852,276

[45] Date of Patent: Aug. 1, 1989

[54] SHOE HAVING A REPLACEABLE LOGO

[76] Inventors: Sebastian E. Savoca, 121 Skymeadow La., Leola, Pa. 17540; Samuel E. Savoca, 3044 Linda La., Sinking Spring, Pa. 19608

[21] Appl. No.: 146,415

[22] Filed: Jan. 21, 1988

[51] Int. Cl.[4] ..... A43B 23/24

[52] U.S. Cl. ..... 36/136; 40/636

[58] Field of Search ..... 36/136, 132, 1; 40/2 E, 40/537; 2/244, 245, 246

[56] References Cited

U.S. PATENT DOCUMENTS

| | | | |
|---|---|---|---|
| 396,536 | 1/1889 | Brown | 40/537 |
| 1,520,224 | 12/1924 | Bush | 40/2 E |
| 1,625,934 | 4/1927 | Cobb | 40/17 |
| 1,952,409 | 3/1934 | Berg | 40/17 |
| 2,801,477 | 8/1957 | Adams et al. | 36/2.5 |
| 3,082,556 | 3/1963 | Schwartz et al. | 40/2 E |
| 3,564,736 | 2/1971 | Cunningham | 36/1 |
| 4,146,985 | 4/1979 | Margulies | 40/537 |
| 4,516,337 | 5/1985 | Adamik | 36/136 |
| 4,611,416 | 9/1986 | Lin | 36/136 |
| 4,644,673 | 2/1987 | Gamm | 36/136 |
| 4,697,362 | 10/1987 | Wasserman | 40/2 E |
| 4,712,314 | 12/1987 | Sigoloff | 36/112 |

*Primary Examiner*—Steven N. Meyers

[57] ABSTRACT

The present invention is a shoe comprising a quarter panel over a part of which an outer material is secured so as to form a frame or opening positioned at the side of the shoe. An insert, such as a design or logo, is reversibly secured within said frame by a pressure sensitive adhesive. The insert is further held in place by a flexible lip formed by the outer material which overlaps the edges of the insert material.

9 Claims, 1 Drawing Sheet

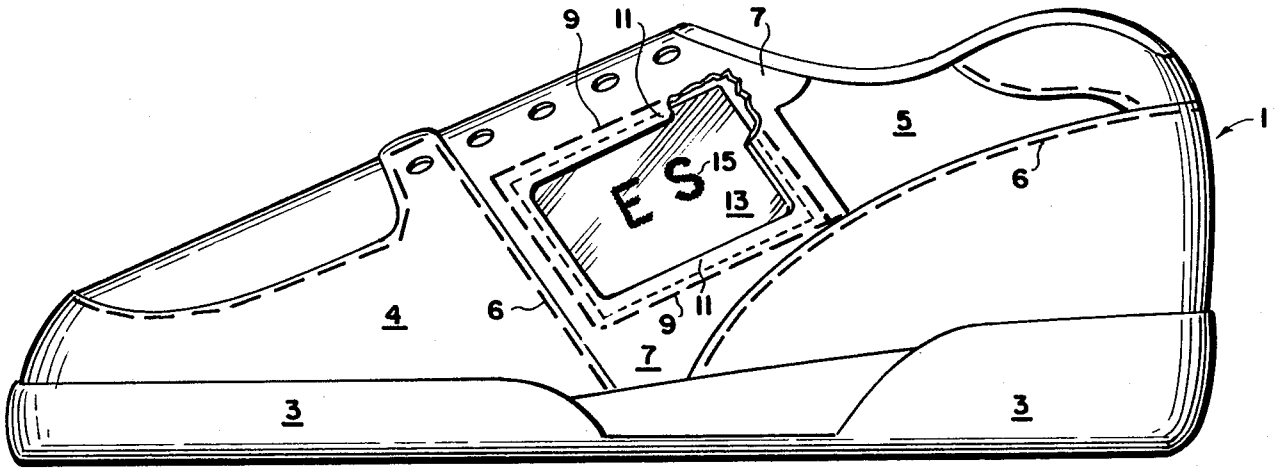
1
3
4
5
6
7
9
11
13
15
E
S

SHOE HAVING A REPLACEABLE LOGO

TECHNICAL FIELD OF THE INVENTION

The present invention relates to a shoe, such as an athletic shoe, having a replaceable logo or design.

BACKGROUND OF THE INVENTION

In the past, various attempts have been made to produce shoes having logos or designs which are securely attached to the shoe, but can readily be removed and replaced. U.S. Pat. No. 1,952,409 discloses in combination, a shoe having a strip of material secured thereto so as to form a pocket which is open at one edge, wherein a logo or identification tag can be slid into the pocket and held securely and also be visible through an opening in said pocket. Similarly, U.S. Pat. No. 2,801,477 discloses a shoe, such as an oxford type shoe, having a transparent patch-like pocket attached to the upper portion of the shoe. The pocket has an opening along an edge for reception of a flat plaque which is adapted to be inserted through the opening behind the patch for display therethrough, the plaque being interchangeable and shaped to fill the pocket.

U.S. Pat. No. 3,564,736 discloses a shoe having a plastic or metal frame formed with an opening and secured to the shoe in combination with an ornamental patch or design, removably secured to the frame so as to show through an opening in the frame. The frame is removably secured to the shoe, such as by resilient clips, and the patch itself is removably secured to the frame such that each are interchangeable.

U.S. Pat. No. 4,516,337 discloses a shoe structure in which a saddle or upper portion of the shoe comprises an inner and outer wall. A window is provided in the outer wall and a plastic element is secured around its outer edges to the outer edges of the window to provide a means for visually displaying an article disposed rearwardly thereof. One of the shoelace carrier portions of the shoe located above the saddle is also formed with an inner and outer member. The outer member of shoelace carrier is secured to the outer wall of the saddle, along the upper edge of said wall. The inner member of the shoelace carrier is either part of, or is secured to, the inner wall of the saddle along the upper edge of said wall. A pocket is provided by securing three edges of the window and plastic element to the inner wall, while leaving one edge unattached to form an entranceway for the insertion of a display into said pocket. After insertion of a picture or display, it is thus visible through the plastic piece. After the picture or design is in position, the shoelaces can be passed through eyelets provided in the inner and outer members of one of the shoelace carriers and, when laced, the shoelace carriers are joined together to completely cover the entranceway to the pocket.

U.S. Pat. No. 4,611,416 discloses a shoe design whereby a pocket area is provided between the shoe quarter and an outer material overlying the quarter, with an access opening adjacent to the eyestay portion of the shoe. A window material is provided in the outer material over the quarter portion of the shoe which allows a display card or logo to be inserted into the pocket formed by the outer portion and the quarter panel and such that said design or logo is visible from the exterior of the shoe. Access to the pocket is achieved via an access opening located above the pocket, such that the display card or logo can be slid into the pocket. In a preferred embodiment, the access opening is provided with a zipper closure.

BRIEF SUMMARY OF THE INVENTION

The present invention is a new type of shoe, such as an athletic shoe having a replaceable logo or design. The shoe comprises a typical shoe design, having a sole, optionally a heel, and a basic body containing sides each having a vamp and a quarter panel, along with all the other optional features which may be present in typical shoes. The shoe of the present invention comprises a side having a quarter panel over a part of which an outer material is secured, said outer material having a cut-out section forming a frame or opening. The outer material is secured to the quarter portion by stitching positioned such that a flexible lip is formed by the outer portion along the perimeter of the frame or opening. An insert material, such as a thin piece of leather, polyurethane, nylon, polyvinyl chloride or cotton content cloth is positioned within the frame or opening and secured to the quarter panel by an adhesive, such as a pressure sensitive adhesive. The insert material is positioned within the frame or opening, such that the flexible lip formed by the outer material overlaps the edges of said insert material to assist in holding the insert in place.

The insert material, typically contains a picture or a logo such as embossed, embroidered, or printed, initials, seal or name and is affixed to the quarter panel via a pressure sensitive adhesive selected such that said insert material is easily removed and replaced with a different insert. The present shoe design allows for such inserts to be easily interchangeable, yet held securely by both the pressure sensitive adhesive and the flexible lip portion of the outer material, without the necessity of detachable frames, slits in the outside of the shoe, or zippered window pockets, as are required in the prior art designs.

BRIEF DESCRIPTION OF THE DRAWING

The drawing of FIG. 1 is a side view of an athletic shoe with a partial cut-away view showing an insert material containing a logo positioned within the frame or opening formed by the outer material and with the edges of the insert material being overlapped by the flexible lip.

DETAILED DESCRIPTION OF THE INVENTION

Referring to the drawing of FIG. 1, there is represented a typical shoe 1, such as an athletic shoe, although the present invention can be applied to any type of shoe in which one would want to fix a logo or a design. Such a typical shoe 1 comprises a sole 3 and two sides each having a front portion or vamp 4 and a rear portion or quarter panel 5 over which is secured, typically via stitching 6, an outer material 7. The quarter panels and vamps can be any type of material which is typically used for shoe construction such as leather (e.g., top grain or finished split), polyurethane (optionally backed by cotton polyester or some type of blend), canvas, polyvinyl chloride, etc. The outer material 7 which overlays a portion of the quarter panel or side 5 can also be made of a wide variety materials just as with the quarter panel 5. The materials of which the quarter panel 5 and the outer material 7 are made can be the same or, as in many cases, may be different. The outer material 7 has a cut-out section forming a frame or opening through which a portion of the quarter panel 5 is visible when an insert material is not positioned within the frame. While the size of the frame is not critical, and often will vary with the size and type of shoe, typically it will range in area from about 1 to 4 square inches. The outer material 7 is further secured to the quarter panel 5 by a second set of stitching 9 positioned such that a flexible lip 11 is formed by the outer portion 7 along the perimeter of said frame or opening. Preferably the flexible lip 11 will extend about ⅛ to ½ inch over the frame or opening so as to anchor an insert material without covering a substantial portion thereof. Additionally, the amount of variation allowed for the overlap of the flexible lip 11, compensates for the inevitable variation in frame or window size that occurs during the manufacturing process. An insert material 13 is positioned within said frame or opening and is secured to the quarter panel 5 by some type of appropriate adhesive, preferably a pressure sensitive adhesive. The particular pressure sensitive adhesive used will vary depending upon the material of which both the quarter panel and the insert material 13 are made, and typically includes such adhesives as urethanes, latexes, acrylics, rubbers, thermoplastic resins and the like. The insert material 13 which is secured by the pressure sensitive adhesive to the quarter panel 5 is also further held in place by being positioned such that the flexible lip 11 formed by the outer material 7 overlaps the edges of the insert material 13. Consequently, it is preferred that the insert material 13 be sized so as to completely fit within the frame, yet be overlapped on all sides by the flexible lip 11.

The combination of a pressure sensitive adhesive, along with the overlapping flexible lip 11, allows the insert material 13 to be held securely in place without coming off during everyday use, but also allows such insert to be removed easily such that one can intentionally replace and exchange various different inserts with little trouble. This type of design allows the inserts to be affixed within the frame or opening in a quick and easy manner, without the need of an actual slit or zipper type mechanism on the shoe itself. The insert material 13 may be any type of material which is compatible with the pressure sensitive adhesive and adheres securely, yet reversibly, with the quarter panel 5. Typically such insert materials will be made of leather, polyurethane, nylon, polyvinyl chloride or cotton content cloth, upon which is embossed or embroidered some type of picture or logo 15, such as initials, school names, or organizational I.D.

The shoe design of the present invention shoe is simple and efficient, and can be designed such that a single shoe has such a frame or opening formed by the outer material and containing a logo, on both sides of the shoe, or if desired, on only one side. While the single figure of the drawing depicts an athletic type shoe which contains eyelets for lacing, the present invention is applicable to all types of shoes, including leather dress shoes, golf shoes, tennis shoes, casual wear shoes, children's shoes, and any other type of men's or ladies shoes upon which one would desire to affix some type of logo or picture.

Having thus described the present invention what is now deemed appropriate for Letters Patent is set out in the following appended claims.

What is claimed is:

1. A shoe comprising a side or quarter panel over a part of which an outer material is secured, said outer material having a cut-out section forming a frame or opening and wherein said outer material is secured to said quarter panel by stitching positioned such that a flexible lip is formed by the outer material along the perimeter of said frame or opening; and an insert material located within said frame or opening and reversibly secured to said quarter panel with an acrylic pressure sensitive adhesive and positioned such that the flexible lip formed by the outer material overlaps said insert material.

2. A shoe in accordance with claim 1 wherein said side or quarter panel is a material selected from the group consisting of leather, polyurethane, canvas or polyvinylchloride.

3. A shoe in accordance with claim 1 wherein said insert material contains a picture or a logo.

4. A shoe in accordance with claim 4 wherein said insert material is made from leather, polyurethane, nylon, polyvinylchloride or cotton content cloth.

5. A shoe in accordance with claim 1 wherein shoe is an athletic shoe.

6. A shoe in accordance with claim 1 wherein a logo is embroidered embossed, or printed on said insert material.

7. A shoe in accordance with claim 1 wherein both sides of said shoe contain said outer material forming a window or opening with an insert material positioned therein.

8. A shoe in accordance with claim 1 wherein the frame or opening is from about 1 to 4 square inches.

9. A shoe in accordance with claim 1 wherein the flexible lip extends about ⅛ to ½ inch over the frame or opening.

* * * * *